United States Patent [19]

Ellis

[11] Patent Number: 4,980,928

[45] Date of Patent: Jan. 1, 1991

[54] CONVERTIBLE CAP AND CAPE COMBINATION

[76] Inventor: Aileen Ellis, 2210 Arbutus St., Vancouver, British Columbia, Canada, V6J 3Y1

[21] Appl. No.: 257,702

[22] Filed: Oct. 14, 1988

[30] Foreign Application Priority Data

Oct. 16, 1987 [CA] Canada ..... 549526

[51] Int. Cl.[5] ..... A41D 3/08; A42B 1/06

[52] U.S. Cl. ..... 2/88; 2/185 R; 2/199; 2/209.1; D2/181

[58] Field of Search ..... D2/180, 181, 246, 515; 2/185 R, 187, 190, 199, 209.1, 88, 89

[56] References Cited

U.S. PATENT DOCUMENTS

| | | | |
|---|---|---|---|
| 59,092 | 10/1866 | Stattman | 2/196 X |
| D. 136,334 | 9/1943 | Witz | D2/246 |
| 361,717 | 4/1887 | Postman | 2/195 |
| 573,618 | 12/1896 | Rice | 2/88 |
| 679,111 | 7/1901 | Dick | 2/185 R |
| 822,986 | 6/1906 | Rochet | 2/187 X |
| 946,770 | 1/1910 | Sands | 2/187 X |
| 1,050,310 | 1/1913 | Steinberg et al. | 2/172 |
| 1,234,828 | 7/1917 | Tramana | 2/190 X |
| 1,556,390 | 10/1925 | Woodley | 2/88 X |
| 1,598,314 | 8/1926 | Rosenberg | 2/195 |
| 1,599,798 | 9/1926 | Stockton | 2/89 |
| 1,786,960 | 12/1930 | Paradise | 2/88 |
| 2,003,886 | 6/1935 | Hoffeld | 2/190 |
| 2,147,872 | 2/1939 | Wittcoff | 135/20 |
| 2,319,983 | 5/1943 | Furman | 2/88 X |
| 2,372,110 | 3/1945 | Noone | D2/181 X |
| 2,412,415 | 12/1946 | Navon | 2/88 X |
| 2,462,679 | 2/1949 | Rosenau | 2/187 X |
| 2,584,896 | 2/1952 | Maffris | 2/185 R |
| 2,708,273 | 5/1955 | Bonaventura | 2/196 |
| 2,736,035 | 2/1956 | Spreiregen | 2/195 |
| 2,736,284 | 5/1956 | Sidelmann | D2/180 X |
| 2,828,487 | 4/1958 | McNeill et al. | 2/187 X |
| 2,856,607 | 10/1958 | Richardson | 2/172 |
| 2,986,741 | 6/1961 | Brasington, Jr. | 2/172 |
| 2,987,510 | 8/1959 | Forbes-Robinson | 2/187 X |
| 3,376,581 | 4/1968 | Gettinger | 2/209.1 |
| 3,469,264 | 9/1969 | Harris | 2/187 |
| 3,546,708 | 12/1970 | Chapman | 2/89 |
| 4,096,590 | 6/1978 | Keshock | 2/180 |
| 4,164,089 | 8/1979 | George | 43/1 |
| 4,321,708 | 3/1982 | Troiano | 2/10 |

FOREIGN PATENT DOCUMENTS

| | | | |
|---|---|---|---|
| 138475 | 12/1932 | Fed. Rep. of Germany | 2/196 |
| 138135 | 2/1934 | Fed. Rep. of Germany | 2/88 |
| 825461 | 11/1951 | Fed. Rep. of Germany | 2/187 |
| 626783 | 9/1927 | France | 2/190 |
| 316715 | 11/1932 | Italy | 2/196 |
| 101527 | 3/1941 | Sweden | 2/187 |

*Primary Examiner*—Werner H. Schroeder
*Assistant Examiner*—Sara M. Current
*Attorney, Agent, or Firm*—Klarquist, Sparkman, Campbell, Leigh & Whinston

[57] ABSTRACT

This invention pertains to a novel head or head and shoulder covering which can be used as a garment or can be modified to form an umbrella-like weather protecting device. More particularly, when used as a head covering this device contains within it a cape which may be deployed and draped about the shoulders. It is an article of clothing for a person comprising a head covering such as a cape, visor or headband, and a deployable cape for covering at least the shoulders of the person, whereby, in a deployed position the cape is draped about at least the head and shoulders of the person leaving the face of the person uncovered and in the stowed position the cape is stowed within the head covering. The cape can be sufficiently long that it covers the feet of the wearer.

2 Claims, 4 Drawing Sheets

CONVERTIBLE CAP AND CAPE COMBINATION

FIELD OF THE INVENTION

This invention pertains to a novel head or head and shoulder covering which can be used in any size by both females and males as a garment or can be modified to form an umbrella-like weather shield. More particulary, the head covering, such as a cap, visor or headband, contains within it a cape of any length which may be deployed and draped about the shoulders, chest and back, and legs and feet of the wearer.

BACKGROUND OF THE INVENTION

Articles of clothing which provide a head covering and a weather shield when worn about the shoulders or body, and, when used in combination with other items, such as a pole, provide an umbrella-like weather protecting device, are not generally available. The prior art discloses hats with attached scarves, ear and neck protectors, rain shielding veils, hats which convert into capes, hats in which the peak can be folded up inside the hat, and ponchos which can be turned into weather protecting means by the use of a rigid support structure. None of the prior art discloses a hat with a cape contained within, which can be pulled out from the hat and worn at the same time the hat is worn, giving the hat the shape and style desired by the wearer.

Several pertinent patents disclose various articles of clothing:

| Patent No. | Inventor |
|---|---|
| 2,708,273 | Bonaventura |
| 1,050,310 | Steinberg |
| 2,856,607 | Richardson |
| 2,736,035 | Spreiregen |
| 361,717 | Postman |
| 1,598,314 | Rosenberg |
| 573,618 | Rice |
| 4,321,708 | Troiano |
| 2986,741 | Brassington |
| 2,147,872 | Wittcoff |
| 4,164,089 | George |
| 4,096,590 | Keshock |
| D 136,334 | Witz |

The Steinberg patent discloses ear and neck flaps which fold down out of an upper cap and which can be retained within the cap. The patent is distinguishable in that it lacks both the cape feature and the feature which enables the converting a plurality of such articles of clothing into an umbrella-like weather protecting device. Also lacking is the mechanism by which a full length cape can be retained within the head covering.

The Witz design merely discloses a hat with attached decorative scarves which are designed to lie down behind the hat and head of the wearer. The design discloses no functional utility as a weather protecting means, not being designed as such, and in no way discloses the feature of the claimed invention in which the article of clothing is converted into an umbrella-like weather protecting means.

Richardson discloses a pull down plastic perforated veil covering the entire head, extending to just below the chin, and being stowed in the upper hat device by the means of a draw string. This invention discloses no method for the stowing of a full length cape and also discloses no feature similar to the umbrella-like weather protecting means of the claimed invention.

Bonaventura teaches ar article of clothing which may be alternately worn as either an apron, a hat, or a cape. The claimed invention may be distinguished in that the cape of the claimed invention pulls out from a hat, the cape remaining attached to the hat, whereas the Bonaventura device is either a hat, or a cape, but not both simultaneously.

Wittcoff discloses a hat which may be turned into a parasol by the means of a centrally connected support rod. This device is easily distinguishable in that it does not disclose a hat containing a cape which may be converted into an umbrella-like weather protecting device.

Brassington merely discloses a scarf, of similar shape as the Witz scarf, which may be tied about the neck and which covers the back portion of the wearer's head. It discloses no deployable cape to cover the shoulders or any means for converting the scarf into an umbrella-like weather protecting means.

George discloses a weather protecting means which requires a rigid support structure. Also, this device cannot be worn as a head covering. Postman merely discloses a cap with a retractable peek. The claimed invention is distinguishable in that it uses a detachable visor.

SUMMARY OF THE INVENTION

An article of clothing comprising a head covering and a detachable deployable cape of any suitable length stowed within the head covering whereby, in the deployed position said deployable cape is draped about at least the head and shoulders of the wearer, and in the stowed position said deployable cape is stowed completely within the head covering. Said detachable deployable cape when deployed may be draped about at least the shoulders, back and chest of the wearer, said deployable cape being securable about the front torso of the wearer.

The head covering can include a releasably detachable visor and also a releasable means for stowing and securing the deployable cape within the head covering, the releasable stowing mears comprising a slit which forms a pocket in the inner lining of the hat, or some other fastening device such as a hook and pile fastener (Velcro), a zipper, or a drawstring attached to, and holes in, the inner lining of the head covering. The releasable means for stowing and securing the deployable cape may be further comprised of an inside flap attached to the inner lining of the head covering, the inside flap having a fastening means or lacing holes along its edges.

The deployable cape further comprises an inside pocket and a sleeve around its periphery. The peripheral sleeve is adapted to receive a cape periphery support which can support the periphery of the cape. The support may be comprised of a resilient flexible plastic rod such as fiberglass having female and male ends which can be joined together to form a hoop, or a helically coiled flexible wire-like material which may be modified to form a hoop when fed through the sleeve. A full cape which extends 360° about the wearer can be used to form an umbrella. A plurality of smaller deployable capes may be laid adjacent to one another with the sleeves aligned adjacently such that the cape periphery support through the plurality of sleeves forms a circle. When the plurality of deployable capes are detachably joined along their common edges, the resulting weather shield may be used in an umbrella-like fashion by connecting an elevating support comprising a plurality of linearly connected poles to the central area of the circular weather shield. The elevating support may be further comprised of a detachable disclike object mounted on the uppermost end of the elevating support to assist in supporting the central area of the circular weather shield.

The invention further comprises a portable bag for storing and carrying a plurity of poles, a helically coiled cape periphery support, a disc-like object and a plurality of deployable capes, said portable bag having a plurality of pole carrying sleeves, an area for carrying a plurality of deployable capes and a pocket for carrying a helically coiled cape periphery support and a disc-like object.

In a further embodiment, the cape can be sufficiently long so as to cover the legs and feet of the wearer and serve as a body suit.

DRAWINGS

The attached drawings disclose the specific embodiment of the invention which should not be construed as limiting the spirit or scope of the invention in any way.

Figure 3:
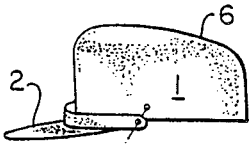
FIG. 3 is an exploded side elevation view of the head covering and visor.
Figure 3A:
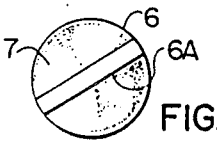
Figure 7:
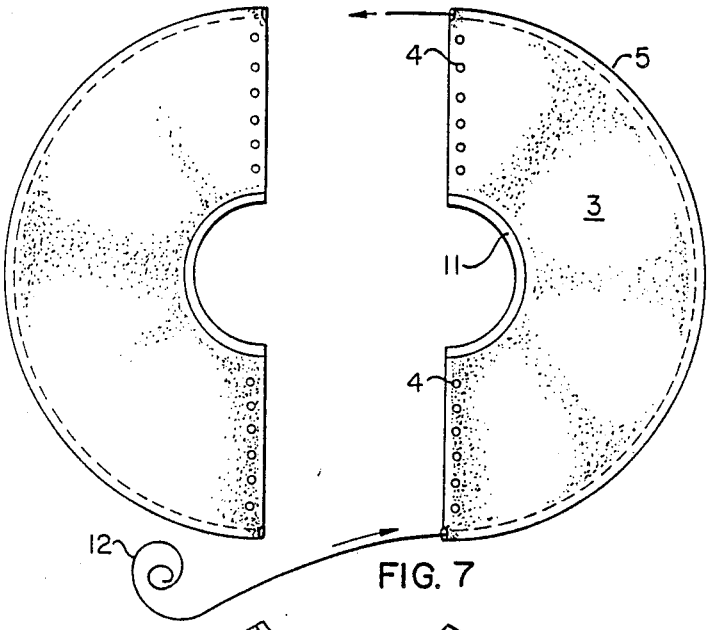
Figure 8:
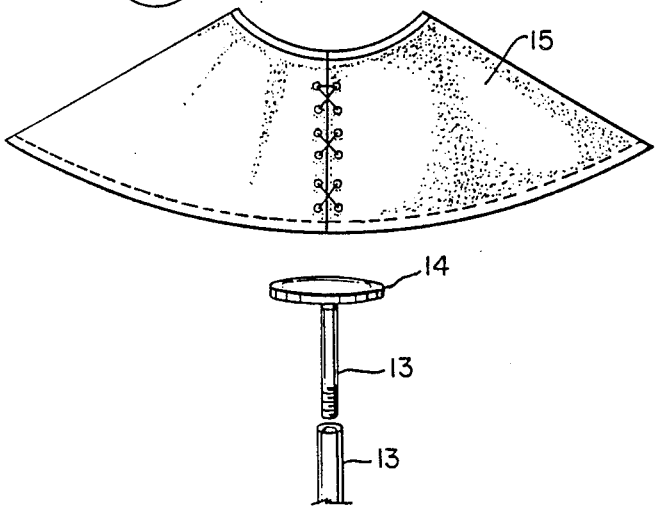
Figure 15:
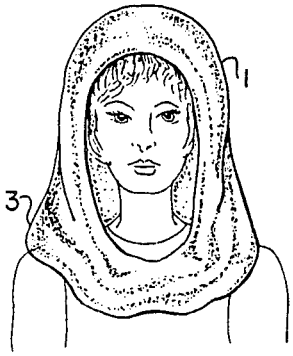

FIG. 3*a*, which appears on the same sheet as FIGS. 7, 8 and 15, is a bottom view of the head covering with a slit lining for stowing the cape.

Figure 4:
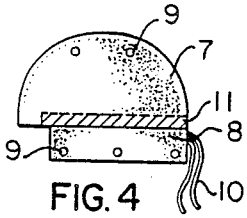

FIG. 4 is a side elevation view of the inner lining removed from the head covering, showing the inner lining, inner flap and drawstring.

Figure 5:
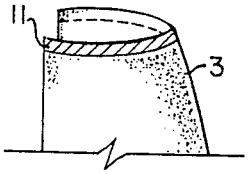

FIG. 5 is a perspective view of the deployable cape as it would look attached to the inner lining.

Figure 6:
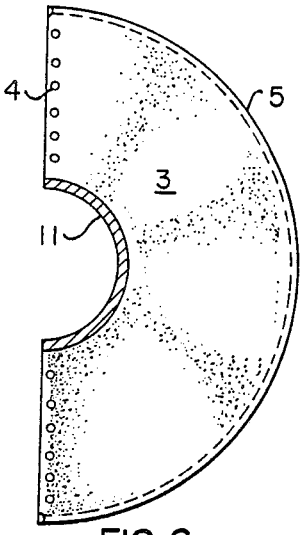

FIG. 6 is a plan view of the deployable cape.

FIG. 7 is a plan view of two adjacent deployable capes as they would be arranged to form an umbrella-like weather protection device, showing the method for joining the two deployable capes and also showing the wire helix as it would thread into the peripheral sleeve to form the cape periphery support.

FIG. 8 is an exploded view of the complete umbrella-like weather protection device showing the components of the elevating support.

Figure 9:
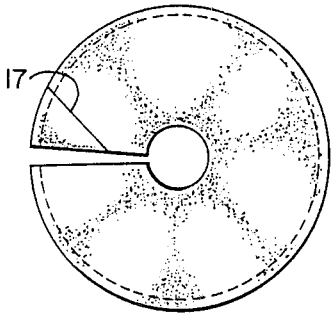

FIG. 9 is a top view of a full cape.

Figure 10:
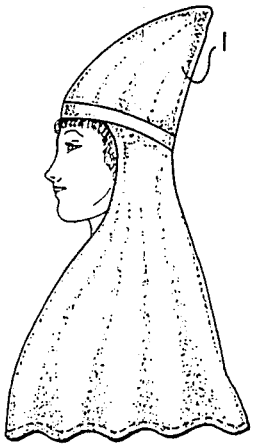
Figure 11:
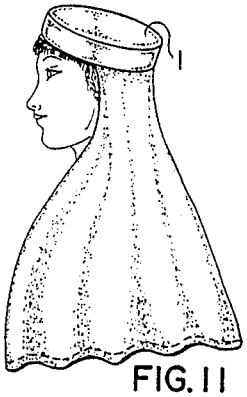
Figure 12:
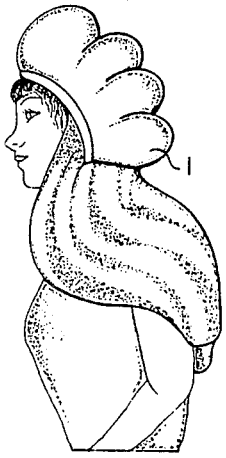

FIGS. 10, 11 and 12 depict side perspective views of various hat and cape designs.

Figure 13:
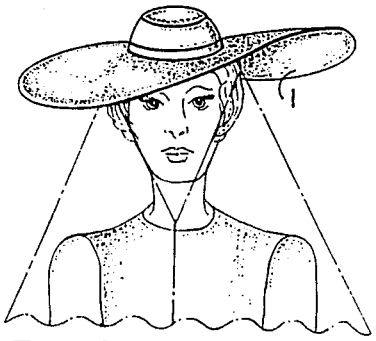

FIG. 13 depicts a frontal perspective view of a woman wearing a broad brimmed hat, with the cape (shown in dotted lines) tucked up inside.

Figure 14:
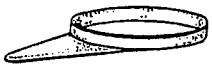

FIG. 14 depicts a side perspective view of a visor with head strap which may be worn in association with the hat and cape.

FIG. 15, which appears on the same sheet as FIGS. 3*a*, 7 and 8, depicts a perspective view of a woman wearing the head covering and the cape in a stylish middle east manner.

Figure 16:
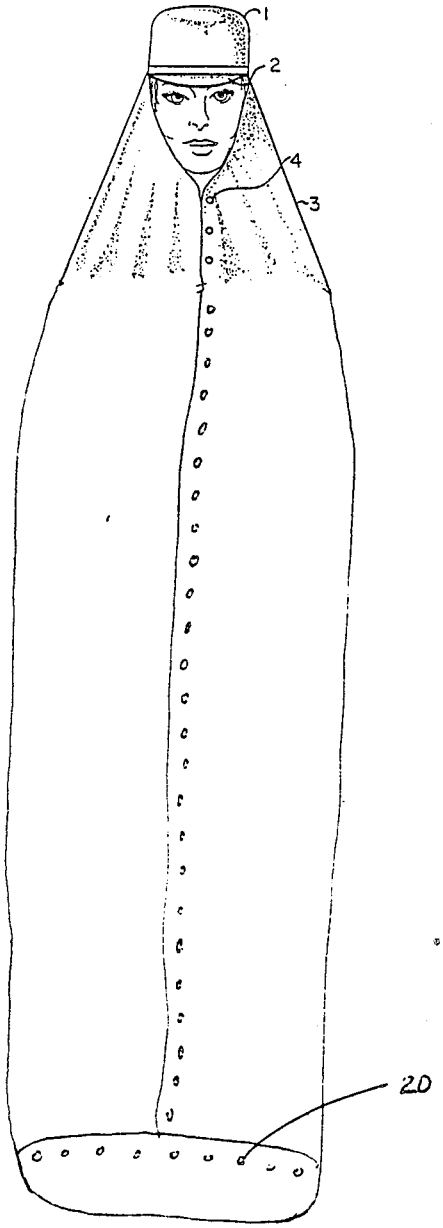

FIG. 16 depicts a frontal perspective view of a woman wearing the hat and cape as a thermal body suit.

DETAILED DESCRIPTION OF A SPECIFIC EMBODIMENT OF THE INVENTION

The invention embodies a head covering with a detachable visor and a deployable cape, the cape being stowed, when not deployed, against or inside the inner lining of the head covering, being held in place by the inner lining or an inner flap and lacing arrangement. The detachable cape when deployed falls about at least the shoulders of the wearer and may be closed about the front, that is, under the chin of the wearer, leaving the face open.

This invention pertains to a novel head or head and shoulder covering, in any size, for both males and females, which can be used as a garment or can be modified to form an umbrella-like weather shield. More particularly, the head covering contains within it a cape of any length which may be deployed and draped about the shoulders, chest and back. It is a personal article of clothing comprising a head covering and a deployable cape for covering at least the shoulders of the person whereby, in a deployed position the cape is draped about at least the head and shoulders of the person, leaving the face of the person uncovered. In the stowed position, the cape is stowed within the head covering in one manner by a slit in the lining, in another manner by using a flap-type closure or in a third manner, by use of snaps, buttons, a zipper, Velcro, or a sewing device. The cape can be completely removed if required. The cape can be of any length to floor length and can be worn separately or attached to the headpiece. The headpiece can be a pillbox-type hat or tam of various shapes and deployment, or a sombrero, top hat, or any suitable hat containing an area sufficient to enclose a cape, or one to which a cape could be attached.

The above-named wearing apparel may be transformed into an umbrella-like weather shield by fitting a plate-like device made of a light plastic or other suitable material into which can be positioned or screwed either telescopic pole sections, cans or bottles or any container segments that fit one into another to form a pole of any desired height.

Both the wearable part of the garment or the item used to transform it into an umbrella-like structure can be from any material or fabric. Finally, to ensure the spread of the cape into an umbrella-like stance, it is designed with a bottom hem into which a plastic tube or hoop or possibly a wire hoop, depending upon availability of materials for best use, can be inserted.

This invention can be worn in many different ways: (1) as a hat; (2) hat with visor; (3) hat or visor with veil; (4) hat or visor with cape over torso; (5) hat or visor with cape completely in front of the neck over the opposite shoulder; (6) hat with part of cape tucked inside to form any unique shape the wearer desires; (7) cape by itself as a cover for evening wear; (8) cape (short version for hairdressing or cosmetic uses); and (9) with a cape sufficiently long to cover the feet of the wearer and serve as a heat and body suit.

The invention can be used as a stationary shield from rain or sun or inclement weather by:

1. Raising the hat and cape extended on a telescopic pole or extended cans or bottles on the beach (shorter version) as a sun or rain shield.

2. Extending the length for use as a temporary "tent" to change into bathing suits at public beaches.

3. In desert climates, the cape may be used as an evening cover up "blanket".

4. Persons with back problems can roll up the cape as a "pillow support" for long car, plane or bus journeys.

Two versions of the same garment can be used for both sexes. One version can be described as a peace version to be promoted toward world peace, which will carry a dove symbol along with a peace poem to be placed in a cape pocket. The second version can be categorized as a high fashion version, without the dove symbol or poem, constructed of high quality fashionable fabric.

In its full shape, it is not necessary to join two or more capes and hats together to form a closed umbrella-like device. For example, if a cape is only a segment of a circle, for example, $\frac{2}{3}$, one would join the two edges together to form a truncated cone which is an umbrella-like shape. The geometry of the cape is critical to its deployment in combinations of two or more (four is the practical limit) as follows: two capes of approximately $\frac{1}{2}$ circle each make one umbrella, three capes of approximately $\frac{1}{3}$ circle each make one umbrella, and four capes of approximately $\frac{1}{4}$ circle each make one umbrella. Likewise, one full cape makes one umbrella.

In its simplest form then, the accessories which convert the hat/cape into an umbrella-like device consist of (a) a telescoping pole such as a leg of a camera tripod, or (b) a pole consisting of several screw-together type pieces (tent pole style), or (c) a pole consisting of two or more push together poles and a disc which can screw into the top of the pole. The cape is draped on the disc. The bottom end of the pole can be stuck into the sand or ground. The flexible plastic hoop is inserted into the bottom cape sleeve edge to form an umbrella-like cover. The entire assembly can be dismantled and carried in a compact light weight carryall bag.

As an expedient measure, a single hat and cape combination may be deployed as an umbrella-like device simply by draping the hat and cape combination over the top of the pole or disk.

The cape, when it is substantially a semicircular shape with a semi-circular notch cut from it, when detached from the head covering, may be used in conjunction with another such cape so that when arranged adjacently they may be detachably joined together so as to form a circular weather shield. This shield may be used in an umbrella-like fashion by the threading of a semi-rigid resilient cape support, made of flexible, resilient plastic such as a fiberglass rod with interlocking ends to form a hoop, or wire-like material, through a sleeve along the periphery of the cape, and through adjacently aligned capes so that a hoop is formed. The circular weather shield is then suspended from a central elevating support comprised of linearly joined rods and a disc-like upper assisting support. The disc-like support can have a diameter larger than the neck opening, or the circumference of the neck opening can be secured to the disc-like support by any suitable fastening means.

Figure 1:
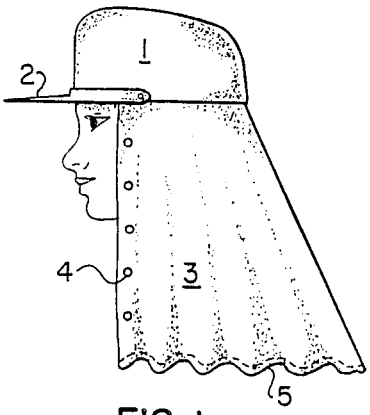
FIG. 1 illustrates a side elevation view of a person wearing the head covering with visor affixed and cape deployed.
Figure 2:
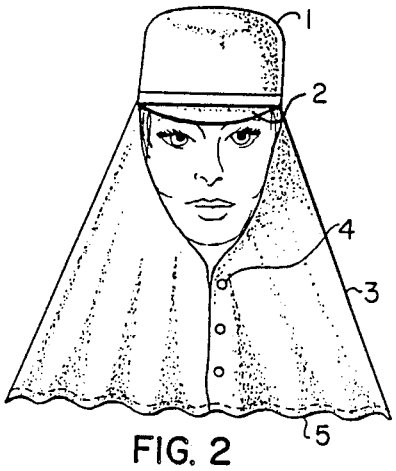
FIG. 2 illustrates a front elevation view of a person wearing the head covering with visor affixed and cape deployed, the cape being partly joined together in front.

FIGS. 1 and 2 illustrate a person wearing the head covering 1, with visor 2 affixed and cape 3 deployed. The figures further illustrate the joining arrangement 4 for closing the cape about the front of the wearer, and the bottom sleeve 5 around the periphery of the cape for receiving the cape support. While buttons 4 are shown in FIGS. 1 and 2, any suitable fastening such as a hook and pile fastener, or a zipper, may be used.

While not shown, a variation of the design includes the cape 3, separated into either horizontal or vertical strips or sections. The strips can be disposed separately about various parts of the wearer's body, for example, one strip wrapped around the neck like a scarf while others hang down or are wrapped about the torso.

FIG. 3 illustrates a view of the head covering 1 showing the visor 2 detached from the outer lining 6. Alternatively, the visor may be as illustrated in FIG. 14 with a head band.

FIG. 4 illustrates an arrangement whereby the inner lining 7, which attaches to the outer lining 6 around the base perimeter of the outer lining 6, extends down to form an inside flap 8. The inner lining 7 and inner flap 8 contain holes 9 through which may be threaded a drawstring 10 in order to retain the cape 3 in the stowed position. Cape 3 is detachably affixed to the inside of the inner lining 7 around the base perimeter of the outer lining 6 by means of the attaching arrangement 11.

Alternatively, as illustrated in FIG. 3*a*, the lining 7 of the head covering 1 can have a separated slit 6*a* or an overlapping slit (not shown) therein, which together with the head covering 1, forms an envelope in which the cape 3 can be deployed.

FIG. 5 illustrates how the attaching arrangement 11 is affixed to cape 3. FIG. 6 illustrates the substantially semi-circular shape of a cape 3 in plan form. This is only one of many possible designs of cape 3. A full 360° cape is illustrated in FIG. 9.

FIG. 7 illustrates how capes 3 may be arranged adjacent to one another and detachably joined by the joining arrangement 4 such as hook and pile fasteners, zippers, and the like, so that a circular weather protecting shield is formed. Also illustrated is the threading of a helically coiled cape support 12 threaded in the peripheral sleeves 5. As explained previously, an umbrella can be formed using only one full cape of the type shown in FIG. 9, together with a pole and a fiberglass rod acting as a support.

FIG. 8 illustrates how, once the cape support 12 is in place and capes 3 joined along their nonsemi-circular edges, the arrangement may be hoisted upon an elevating support comprising an arrangement of rods 13 which may be telescoping rods, or even aluminum cans screwed together with mating ends to form a pole, with a circular disc 14 affixed atop thereof to form a complete umbrella-like device 15.

FIG. 9 illustrates a top view of a full cape with pocket 17 while FIGS. 10, 11 and 13 depict side perspective views of various possible hat and cape designs.

FIG. 13 depicts a frontal perspective view of a woman wearing a broad brimmed hat, with the cape (shown in dotted lines) tucked up inside. Lastly, FIG. 14 depicts a side perspective view of a visor with head strap 16 which may be worn in association with the hat and cape. The head strap 16, if desired, can be of an elastic type material.

FIG. 15, which appears on the same sheet as FIGS. 3*a*, 7 and 8, depicts a perspective view of a woman wearing the head covering and the cape in a stylish middle east manner.

FIG. 16 depicts an embodiment of the cap 1 and cape 3, where the cape is sufficiently long that it covers the feet of the wearer. The base of the cape can be folded over and secured with buttons 20, or some other suitable fastening material such as a zipper or Velcro (trade mark). The fabric can be Mylar (trade mark) so that it is weatherproof. The cape 3 can be insulated for warmth, if required.

The cape and hat can be reversible, can be constructed of fabric of similar or contrasting colours, and is adaptable to virtually any type of fashion design including high fashion design.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

The embodiments of the invention in which an exclusive property or privilege is claimed are defined as follows:

1. An article of clothing for the head, neck, shoulders and body of a person, comprising:

(a) a self-supporting head covering adapted to receive and conceal in the interior thereof a deployable body cape, said head covering comprising an outer shell, an inner lining, and a fastening means for detachably securing the cape to the head covering; and (b) a flexible, waterproof, lined deployable cape adapted to be releasably secured to the head covering and capable of being stowed within the interior of the head covering and being of sufficient length and width that when downwardly deployed the cape covers the neck, shoulders and body of the person, the cape having a sleeve around the periphery of the cape removed from the part of the cape that is adapted to be releasably secured to the head covering, said sleeve being adapted to receive a cape periphery support means, whereby, when in the deployed position, said deployable cape is draped about the head, shoulders and body of the person, and is releasably fastened about the front of the person, leaving the face of the person uncovered, the front edges of the cap being adapted to be releasably secured to another deployable cape, and when in the stowed position, said deployable cape is capable of being stowed within the interior of the head covering means.

2. An article of clothing as defined in claim 1 wherein said cape periphery support means is a resilient rod.

* * * * *